US006167597B1

(12) United States Patent
Malin

(10) Patent No.: US 6,167,597 B1
(45) Date of Patent: Jan. 2, 2001

(54) HIGH COMPRESSION ZIPPER

(75) Inventor: Art Malin, Northbrook, IL (US)

(73) Assignee: Illinois Tool Works, Inc., Glenview, IL (US)

( * ) Notice: Under 35 U.S.C. 154(b), the term of this patent shall be extended for 0 days.

(21) Appl. No.: 09/261,852

(22) Filed: Mar. 3, 1999

Related U.S. Application Data

(63) Continuation-in-part of application No. 09/114,618, filed on Jul. 13, 1998.

(51) Int. Cl.[7] ..... B65D 33/24

(52) U.S. Cl. ..... 24/587; 24/399; 24/400; 383/63

(58) Field of Search ..... 24/399, 400, 587, 24/576; 383/63

(56) References Cited

U.S. PATENT DOCUMENTS

| | | | | |
|---|---|---|---|---|
| 3,565,147 | | 2/1971 | Ausnit . | |
| 4,736,451 | | 4/1988 | Ausnit . | |
| 4,778,282 | * | 10/1988 | Borchardt et al. | 24/587 |
| 4,909,017 | * | 3/1990 | McMahon et al. | 53/410 |
| 5,017,021 | * | 5/1991 | Simonsen et al. | 383/63 |
| 5,198,055 | * | 3/1993 | Wirth et al. | 24/587 |
| 5,368,394 | | 11/1994 | Scott et al. . | |
| 5,509,734 | | 4/1996 | Ausnit . | |
| 5,558,439 | * | 9/1996 | Tilman | 24/587 |
| 5,558,613 | | 9/1996 | Tilman et al. . | |
| 5,573,614 | | 11/1996 | Tilman et al. . | |
| 5,577,305 | * | 11/1996 | Johnson | 24/400 |
| 5,718,024 | * | 2/1998 | Robbins | 24/587 |
| 5,794,315 | * | 8/1998 | Crabtree et al. | 24/587 |

FOREIGN PATENT DOCUMENTS

| | | | | |
|---|---|---|---|---|
| 0515985 | * | 12/1992 | (EP) | 24/399 |

* cited by examiner

*Primary Examiner*—Victor N. Sakran
(74) *Attorney, Agent, or Firm*—Pitney, Hardin, Kipp & Szuch LLP

(57) ABSTRACT

A zipper strip for a reclosable package having a transverse zipper is provided. The zipper strip comprises a male profile and a female profile. Each profile includes at least one interlocking member extending from a base towards the opposite profile interlockable with an interlocking member on the opposite profile. One or both of the profiles is provided with at least one high compression member which allows the interlocked profiles to be sealed to thermoplastic film across the widths of their respective bases without the interlocking members being crushed or distorted.

14 Claims, 5 Drawing Sheets

HIGH COMPRESSION ZIPPER

CROSS-REFERENCE TO RELATED APPLICATIONS

This application is a continuation-in-part of U.S. patent application Ser. No. 09/114,618, filed Jul. 13, 1998, the disclosure of which is incorporated herein by reference.

BACKGROUND OF THE INVENTION

1. Field of the Invention

The present invention relates to reclosable plastic bags and packages of the type in which food products, such as chips and cereal, and other goods are packaged for sale to consumers. More particularly, the present invention relates to a reclosable zipper strip for use in transverse-zippered reclosable plastic bags made on form-fill-seal (FFS) machines.

2. Description of the Prior Art

The present invention relates to improvements in the package-making art and may be practiced in the manufacture of thermoplastic bags and packages of the kind that may be used for various consumer products, but which are particularly useful for food products which must be kept in moisture and air-tight packages, free from leakage until initially opened for access to the product contents, which packages are then reclosable by zipper means to protect any remainder of the product therein.

The prior art is fairly well-developed, but nevertheless remains susceptible to improvement contributing to increased efficiency and cost effectiveness.

In particular the present invention relates to the area of reclosable packaging known as the transverse zipper. When making a bag having a transverse zipper, the zipper is attached transverse to the longitudinal axis of the material used to make the bag, as opposed to being attached to the material parallel to the longitudinal axis. A method and apparatus for making reclosable plastic bags with a transverse zipper on an FFS machine is disclosed in U.S. Pat. No. 4,909,017.

Prior to the introduction of the transverse zipper to the reclosable packaging field, reclosable plastic bags made on FFS machines were typically made with a continuous longitudinal zipper, i.e. a zipper parallel to the longitudinal axis of the thermoplastic film used to make the bags. However, there are two primary problems with the longitudinal zipper technique. First, there is a problem in attaining satisfactory sealing of the bags against leakage since the transverse, or side, sealing bars of the FFS machine must flatten and seal the zipper at the same time they are sealing the thermoplastic film from which the packages are being made. The difficulty with which this sealing is consistently and successfully achieved is reflected by the high occurrence of leaking packages.

Second, the length of reclosable bags made on FFS machines when the zipper is attached parallel to the longitudinal axis of the thermoplastic film is limited to the diameter of the filling tube of the FFS machine. Thus, generally bags of this type are wider than they are long. While such bags are suitable for certain products where shorter bags are desirable, such as cheese and chicken parts, these bags are not suitable for applications in which longer bags are desirable, for example, chips and other snack foods.

Among the approaches taken to solve these problems has been the substitution of a transverse zipper for the longitudinal zipper. When a transverse zipper is provided, the transverse sealing bars associated with the FFS machine do not flatten the zipper during formation of the top and bottom seals of the package since the transverse sealing bars may seal the zipper to the thermoplastic film transversely thereacross without having to flatten the zipper ends. In addition, when a transverse zipper is used the length of the packages made on the FFS machine can be varied while the width of the zipper remains the same.

The present invention relates to a particular type of zipper strip which may be used in transverse zipper applications, a method for attaching the zipper strip to thermoplastic film, a method for making reclosable packages on an FFS machine using the zipper strip-equipped thermoplastic film, and a reclosable package utilizing the zipper strip.

In typical transverse zipper package making applications, flanged zipper strips are utilized. The zipper strips are sealed to the thermoplastic film via the flanges, thereby preventing damage to the interlocking closure elements which would otherwise occur during sealing. However, the use of flanged zipper has proven problematic in that the flanges tend to peel or delaminate from the thermoplastic film due to peel forces transmitted to the flanges during opening of the bag by the bag user.

Although flangeless zipper is well known in the art, such zippers are unsuitable for use in transverse zipper applications because they are too narrow to ensure proper sealing by inaccurate seal bars and because the sealing of those zippers to thermoplastic film will cause damage and distortion to the interlocking closure elements.

It is therefore an object of the present invention to provide a flangeless zipper strip for use in transverse-zippered reclosable plastic bags which overcomes the aforementioned sealing problems. Another object of the present invention is to provide a method for attaching the flangeless zipper strip to thermoplastic film, which thermoplastic film can later be used on an FFS machine to make reclosable packages. Another object of the present invention is to provide a method for making packages from the flangeless zipper strip-equipped thermoplastic film. Yet another object of the present invention is to provide a package which utilizes the flangeless zipper strip.

SUMMARY OF THE INVENTION

Accordingly, the present invention is, in four aspects, a zipper strip for use with transverse zippered bags; a method for attaching the zipper strip to a continuous supply of thermoplastic film; a method for making reclosable bags on an FFS machine using the zipper strip-equipped thermoplastic film; and a reclosable bag utilizing the zipper strip.

In accordance with the first aspect of the present invention, the zipper strip comprises a male profile and a female profile. The male profile includes a base and at least one male interlocking member extending from the base towards the female profile. Likewise, the female profile includes a base and at least one female interlocking member extending from the base towards the male profile, the male and female interlocking members being engageable with each other to join the male and female profiles together. Both profiles are flangeless and of a sufficient width to ensure accurate sealing by the seal bars.

One or both profiles further includes at least one high compression member engageable with a portion of the other profile which allows both profiles to be sealed to thermoplastic film across the widths of their respective bases without the male and female interlocking members being crushed or distorted by the application of heat and pressure directly behind or closely adjacent to the interlocking members by the seal bars. The peel problem associated with flanged zipper is eliminated since both profiles can be completely sealed to the thermoplastic film across the widths of their respective bases.

In the second aspect of the present invention, thermoplastic film is intermittently paid off a continuous supply of the same and fed into an FFS machine. A length of the interlocked zipper strip is attached to the flat film transverse to its longitudinal axis as it advances in bag-length increments by initially sealing, or tacking, one of the profiles the film. The zipper-equipped film may be rolled up and used on an FFS machine at a later time, or may be fed directly into an FFS machine to make reclosable bags.

In the third aspect of the present invention, the thermoplastic film with the transverse zipper strips attached at bag length intervals is fed into an FFS machine where it is formed into a bag, filled, and sealed. Specifically, the transverse zipper-equipped thermoplastic film is folded over the collar of the FFS machine and wrapped around the filling tube to form a tube. The longitudinal edges of the film are then sealed to form a back seam. The transverse sealing jaws then seal the bottom of the tube to form an open bag. The bag is then filled, if desired. Finally, the transverse sealing jaws seal both profiles to opposing bag walls across the widths of their respective bases without sealing the profiles to each other and seal the top of the bag so as to make a completed bag.

In accordance with the fourth aspect of the present invention, the finished bag may be opened by pulling outwardly on the bag walls.

The present invention will now be described in more complete detail with frequent reference being made to the figures identified below.

DETAILED DESCRIPTION OF THE PREFERRED EMBODIMENT

Figure 1:
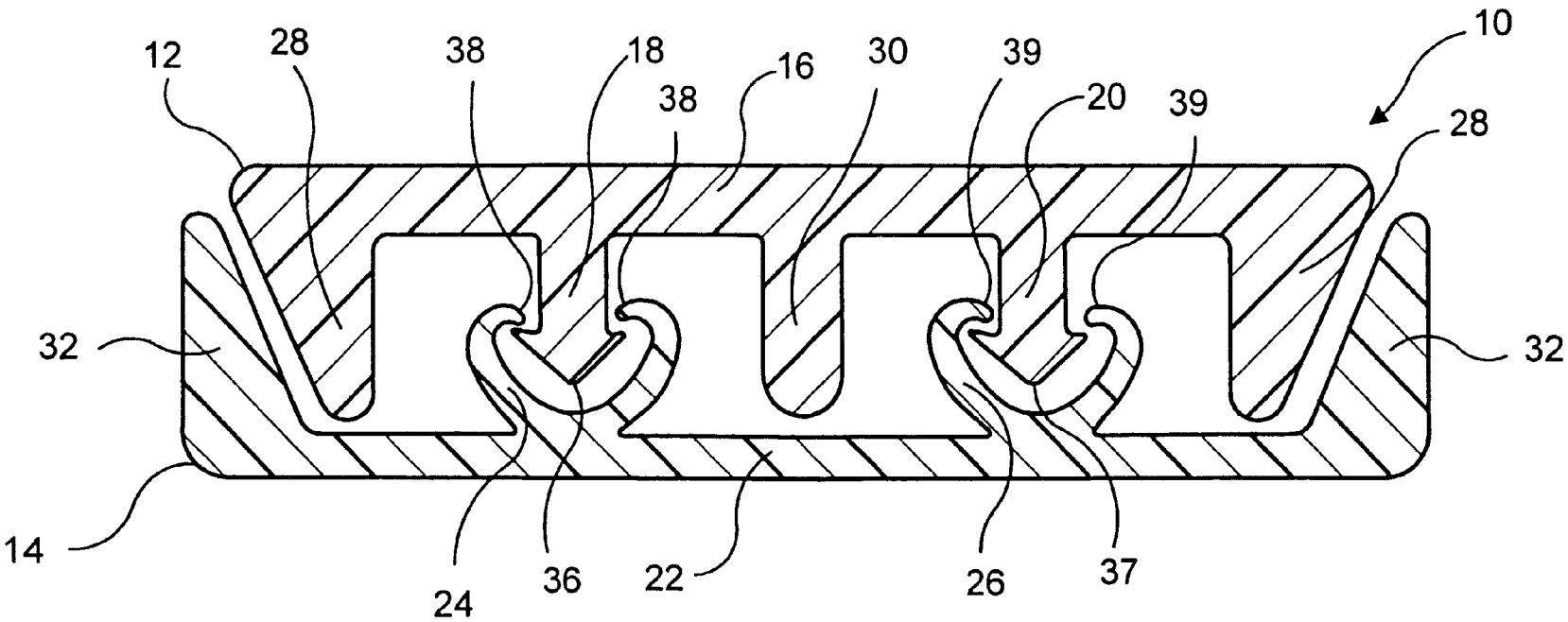
FIG. 1 is a cross-sectional view of a zipper strip in accordance with a first embodiment of the present invention.
Figure 2A:
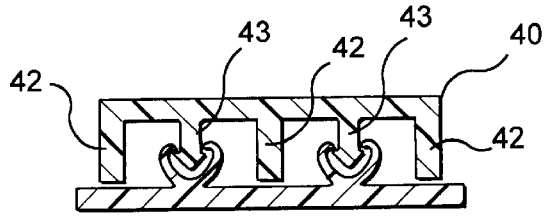
FIGS. 2(*a*)–(*g*) are cross-sectional views of zipper strips in accordance with alternate embodiments of the present invention.
Figure 2B:
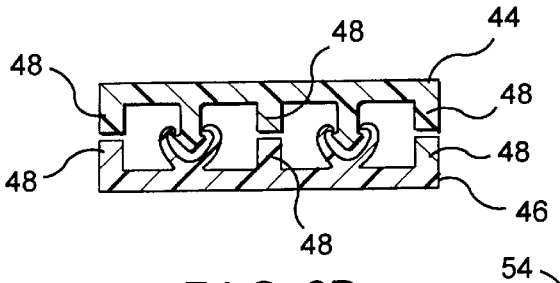
Figure 2C:
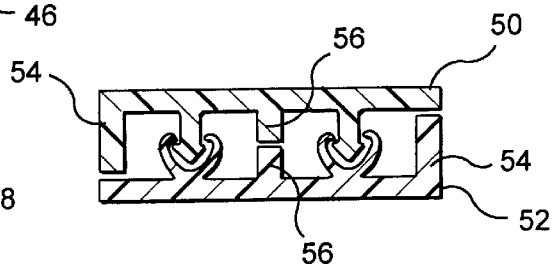
Figure 2D:
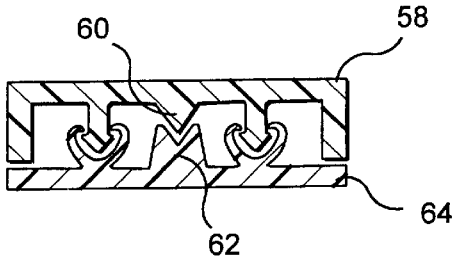
Figure 2E:
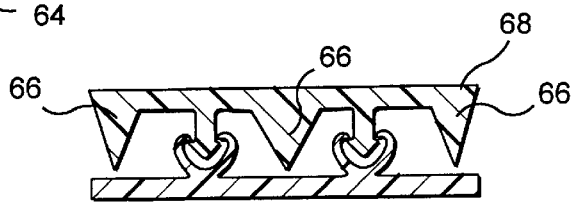
Figure 2F:
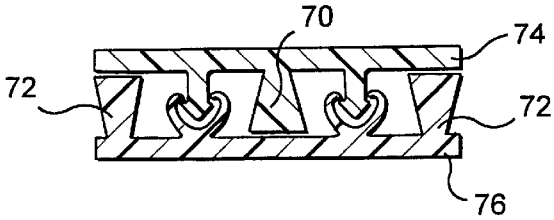
Figure 2G:
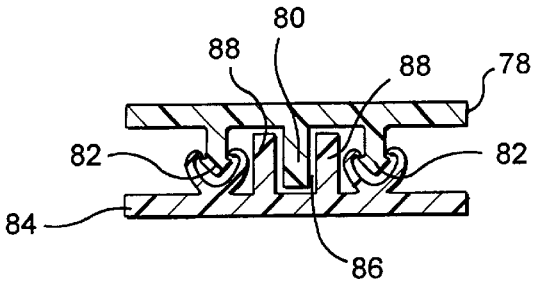

Referring specifically to the Figures identified above, FIG. 1 is a cross-sectional view of a zipper strip 10 in accordance with the first aspect of the present invention.

The zipper strip 10 comprises a male profile 12 and a female profile 14. The male profile 12 includes a base 16 and first and second male interlocking members 18, 20 extending from the base 16 towards the female profile 14. The first and second male interlocking members 18, 20 each have an asymmetrical arrow shape so that the zipper strip 10 is easier to open from one side than the other. In the case of potato chip bags and the like, the male interlocking members will be adapted so that the bag is easier to open from the contents side of the zipper, since such bags are typically opened from the contents side.

The female profile 14 includes a base 22 and first and second female interlocking members 24, 26 extending from the base 22 towards the male profile 12. The first and second female interlocking members 24, 26 are each comprised of two inwardly curving members forming a receptacle or channel into which the first and second male interlocking members 18, 20 may respectively be engaged.

It should be noted that while the foregoing configurations for the male and female interlocking members are preferred, any configuration which provides for interlocking may be used. Moreover, any number of male and female interlocking members may be used.

The male and female profiles 12, 14 are extruded from a plastic material commonly used in the packaging industry, such as polyethylene. In addition, the profiles may be provided with a sealant on their bases to aid in the sealing of the profiles to the thermoplastic film used to make the bags.

The male profile 12 further includes wedge-shaped high compression members 28 at either end of its base 16 and a central high compression member 30 between the first and second male interlocking members 18, 20, all of which extend from the male profile base 16 toward the female profile 14. The high compression members 28, 30 are longer than both of the first and second male interlocking members 18, 20.

The female profile 14 includes wedge-shaped high compression members 32 at either end of its base 22 which contact their opposite wedge-shaped high compression members 28 on the male profile 12 when the profiles are interlocked and pushed together.

The high compression members function in the following manner. As one or both of the interlocked male and female profiles 12, 14 are sealed to thermoplastic film, such as by seal bars, the profiles are compressed together. This compression causes the opposing wedge-shaped high compression members 28, 32 on the male and female profiles 12, 14 to contact each other and the central high compression member 30 of the male profile to contact an inner surface 34 of the female profile base 22. The lengths of the high compression members are such that said contacts occur before the extremities 36, 37 of the male interlocking members 18, 20 contact the female profile 14, or the extremities 38, 39 of the female interlocking members 24, 26 contact the male profile 12, and thereby damage or distort the interlocking members. In addition, the high compression members are much thicker than the male and female interlocking members, thereby ensuring that the high compression members themselves do not distort during sealing or become sealed to the opposing profile.

In this manner the high compression members prevent distortion and crushing of the interlocking members and enable the profiles to be sealed to thermoplastic film across the widths of their bases. In the absence of the high compression members the interlocking members would be distorted and/or crushed by the heater bars, rendering the zipper strip unusable.

Because the zipper 10 is not provided with flanges, in order to ensure that the seal bars seal the profiles to the thermoplastic film, the profiles must be wider than is customary. This extra width ensures that the sealing bars, which are not very accurate, do not miss the narrow zipper during the sealing operation. This extra width also provides the added benefit of making the zipper strip easier for the bag user to close because of the wide feel of the zipper strip.

It should be noted that the present invention is not limited to the number and configuration of high compression members shown in FIG. 1. Any number and any configuration of high compression members may be used to practice the present invention. Examples of other profiles in accordance with the present invention are shown in FIG. 2.

In FIG. 2(*a*), the male profile 40 is provided with three rectangular high compression members 42 longer than either of the male interlocking members 43.

In FIG. 2(*b*), both profiles 44, 46 are provided with three rectangular high compression members 48 which contact an opposite high compression member on the other profile during sealing.

In FIG. 2(*c*), the male and female profiles 50, 52 are each provided with two rectangular high compression members, one of which 54 contacts the base of the opposite profile and the other of which 56 contacts an opposite high compression member on the other profile during sealing.

The embodiment of FIG. 2(*d*) is similar to that of FIG. 2(*a*), except that the center high compression member of the male profile 58 is replaced with a triangular shaped high compression member 60 which mates with a complementary shaped high compression member 62 on the female profile 64 during sealing.

The embodiment of FIG. 2(*e*) is also similar to that of FIG. 2(*a*), except that the high compression members 66 on the male profile 68 are triangular.

The embodiment of FIG. 2(*f*) also makes use of triangular high compression members 70, 72, but the compression members are inverted such that the bases of the triangles, rather than the apexes as in FIG. 2(*e*), contact the base of the opposite profile. Additionally, the male profile 74 is provided with a single central high compression member 70 while the female profile 76 is provided with a high compression member 72 at each end.

In the embodiment of FIG. 2(*g*), the male profile 78 is provided with a central rectangular high compression member 80 longer than the male interlocking members 82 and the female profile 84 is provided with a channel 86 for receiving the high compression member 80. Additionally, the members 88 which form the channel 86, if long enough, may also act as high compression members.

Although profiles having posts and wedges are well known in the prior art, such as disclosed, for example, in U.S. Pat. Nos. 4,736,451, 3,565,147, 5,509,734 and 5,558,614, the posts and wedges in those references do not act as high compression members, but act to stabilize the zipper and/or enhance locking characteristics.

Figure 3:
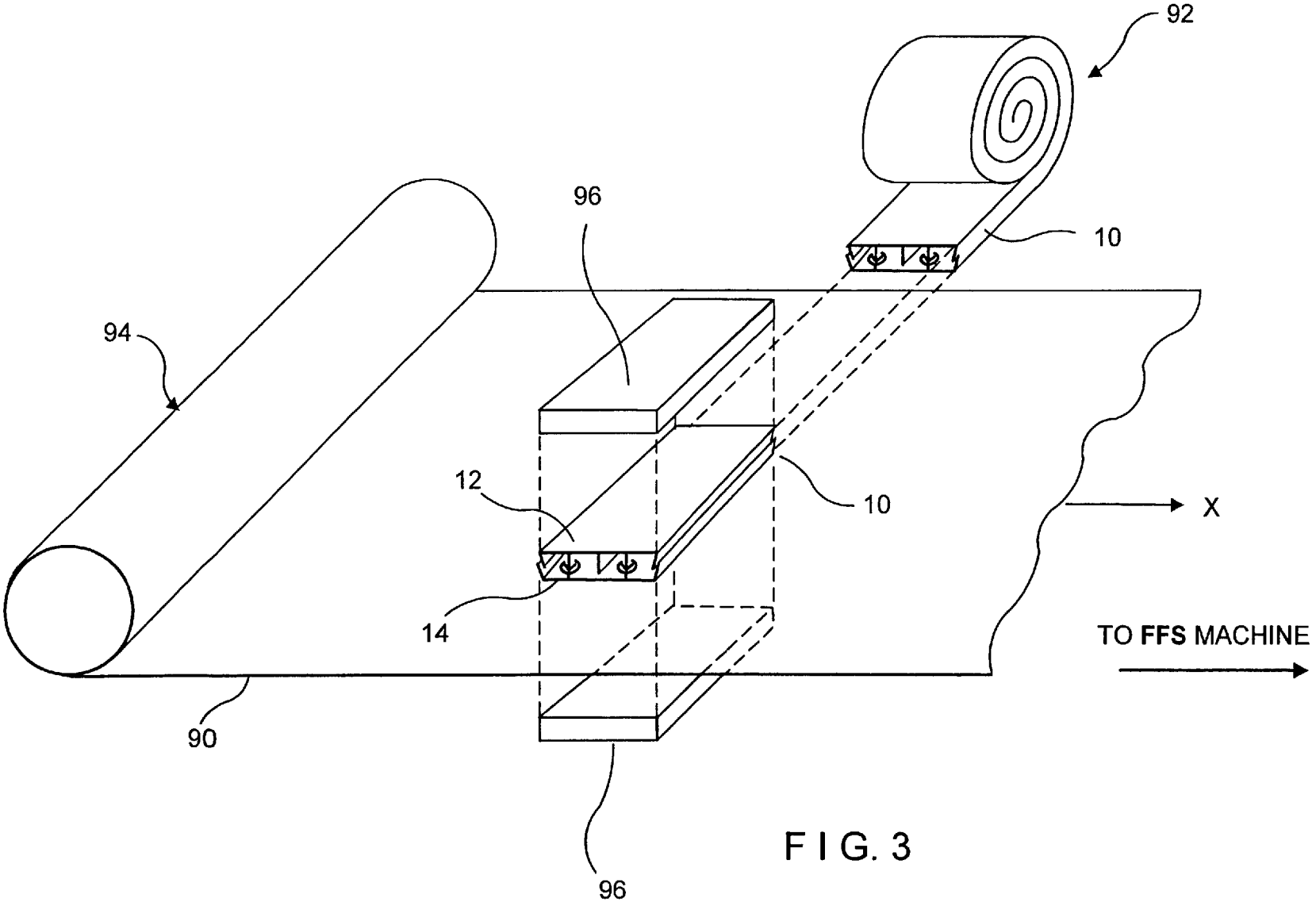
FIG. 3 is a perspective view of the zipper strip of FIG. 1 being attached to thermoplastic film in accordance with the present invention.

FIG. 3 depicts the zipper strip 10 of FIG. 1 being attached to thermoplastic film 90 in accordance with the second aspect of the present invention. The zipper strip is supplied from a continuous roll 92 and is pulled across the film 90 and disposed thereon by a positioning device 116 (not shown in FIG. 3 for clarity). The positioning device 116 can take any of a variety of forms well known to those skilled in the reclosable packaging art, such as a vacuum conveyor for pulling the zipper strip 10 across the film 90 and a knife for cutting the zipper strip 10 from the continuous roll thereof 92.

The thermoplastic film 90 is paid off from a continuous roll 94, as shown in FIG. 3, in increments equal to the length of the bags which will ultimately be formed from the film 90 on an FFS machine. The film 90 has a longitudinal axis X which is parallel to the direction of travel of the film 90. The zipper strip 10 is disposed on the film 90 transverse to the longitudinal axis X with the male profile 12 on top of the female profile 14, or vice versa. As disclosed in U.S. Pat. No. 4,909,017, the zipper strip 10 has a length approximately equal to half the width of the film 90 and is disposed centrally thereon. Seal bars 96 are positioned to attach the female profile 14 to the film 90 by initially sealing or tacking the female profile thereto. The high compression members, as discussed above, prevent the seal bars 96 from damaging or distorting the interlocking members.

Figure 4:
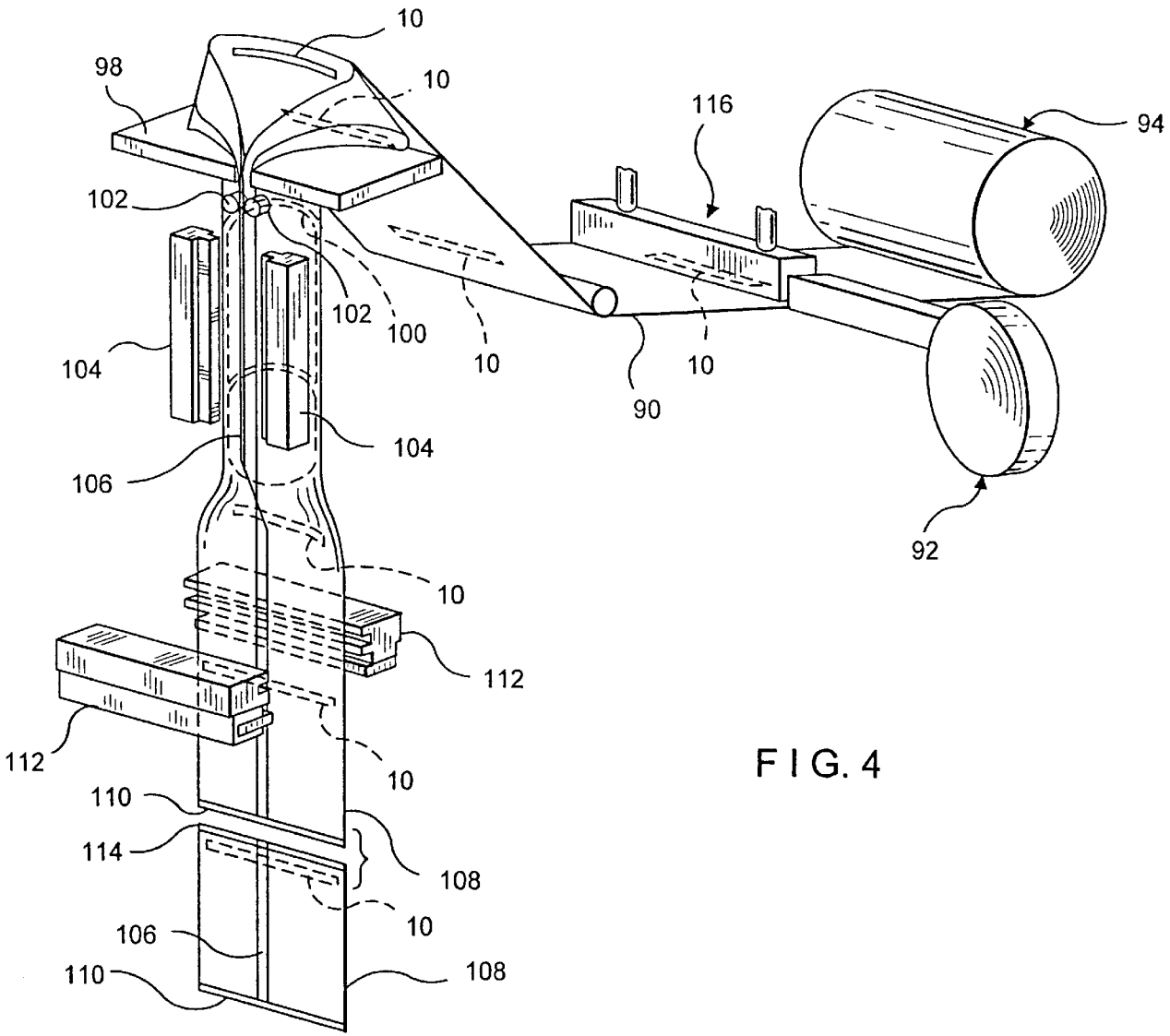
FIG. 4 is a perspective view of an FFS machine making reclosable bags from thermoplastic film in accordance with the present invention.

In the third aspect of the present invention, the transverse zipper-equipped film is fed into an FFS machine, as shown in FIG. 4. The thermoplastic film 90 is fed downwardly over a collar 98 and folded around a filling tube 100. The edges of the film are brought together and pressed together by a pair of rollers 102. The edges are then welded together by seal bars 104 to form a longitudinal back seam 106. Contents may then be dropped through the tube 100 into the bag 108 which has a lower seam 110. As discussed below, the lower seam 110 was made when the preceding bag was completed.

After introduction of the contents, the top of the bag is completed by the action of cross seal jaws 112, which perform four simultaneous functions. First, the cross seal jaws 112 finally seal the male and female profiles 12, 14 to opposing bag walls across the widths of their respective bases. A commercially well known sealant on the profile bases may be used to facilitate the completion of these seals without sealing the profiles 12, 14 to each other. The high compression members, as discussed above, prevent the interlocking members from being crushed and distorted during sealing. Second, the cross seal jaws 112 seal the top of the bag to form a pilfer evident seal 114. Third, the cross seal 112 jaws make the lower seam 110 for the next succeeding bag. And fourth, the cross seal jaws 112 cut the completed bag 108 from the film 90. The completed bag 108 has a pilfer evident seal 114, a transverse zipper 10, a lower seam 110 and a back seam 106.

In order to ensure that the high compression members do not seal to the opposite profile during the sealing process, the ends of the high compression members may be treated, such as with a small ink layer. While the thickness of the high compression members would usually prevent sealing from occurring, as discussed above, this treatment would provide additional insurance or cover a situation where smaller profiles are used.

Figure 5:
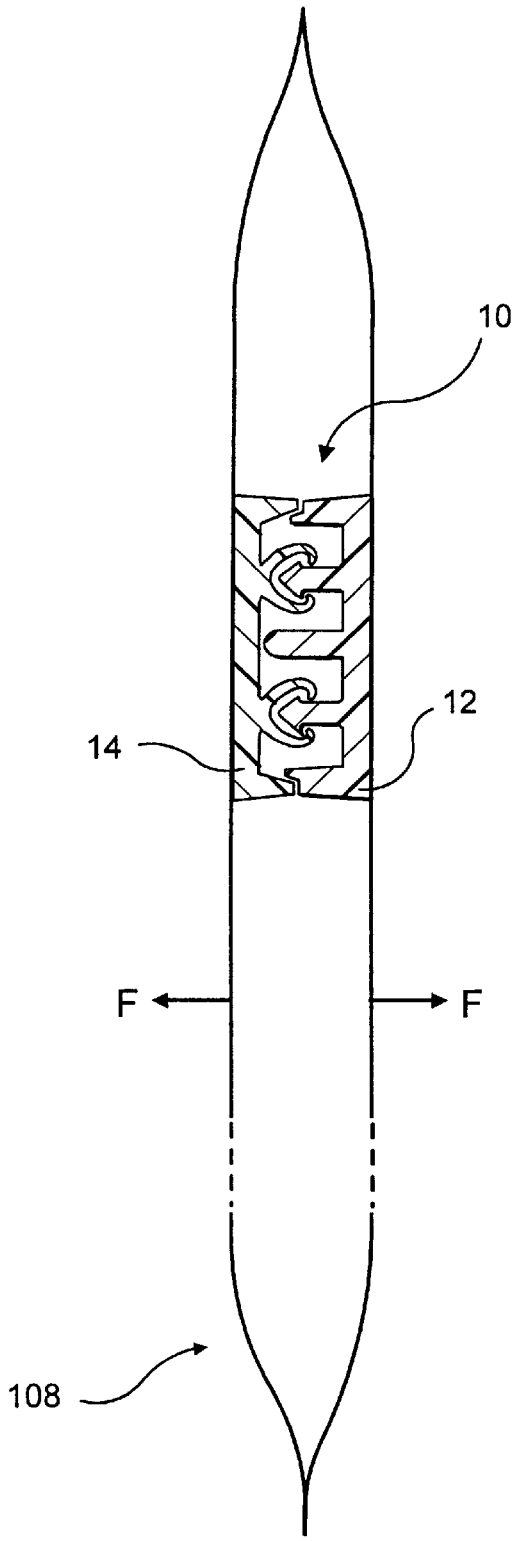
FIG. 5 is a cross-sectional view of a completed bag in accordance with the present invention.

In accordance with the fourth aspect of the present invention, a cross section of the completed bag 108 is shown in FIG. 5. Because the profiles 12, 14 are sealed to the bag completely across the widths of their bases, there is no danger of peeling of either profile from the bag when the bag is opened by the user, as shown by opening forces F (snack food bags, unlike other bags, are typically opened from the contents side).

Thus, in the foregoing manner the objects of the present invention are achieved. Modifications to the above would be obvious to those of ordinary skill in the art, but would not bring the invention so modified beyond the scope of the appended claims.

What is claimed is:

1. A zipper strip for a reclosable package, said zipper strip comprising:

a male profile and a female profile;

said male profile including a base and two interlocking members extending from said base toward said female profile; said female profile including a base and two interlocking members extending from said base toward said male profile, said two male interlocking members being engageable within said two male interlocking members being engageable within said two female interlocking members to join said male and female profiles together;

at least one of said male and female profiles further including first and second high compression members positioned on opposite ends of its base and a third high compression member positioned between its interlocking members extending from its base toward the other profile, said high compression members being contactable with a portion of the other profile when said profiles are interlocked and pressed together so as to prevent the extremities of said interlocking members from contacting the opposite profile;

whereby said profiles can be sealed to thermoplastic film across the widths of their respective bases through the application of heat and pressure without damaging or distorting the male and female interlocking members.

2. The zipper strip according to claim 1 wherein both of said profiles include at least one high compression member contactable with a portion of the other profile.

3. The zipper strip according to claim 1 wherein said male profile includes a pair of wedge shaped high compression members positioned on opposite ends of said male profile base, each of said wedge shaped high compression members being contactable with an opposite wedge shaped high compression member on said female profile.

4. The zipper strip according to claim 1 wherein said high compression members is contactable with the base of the opposite profile.

5. The zipper strip according to claim 1 wherein said male profile includes a high compression member longer than said male interlocking member.

6. The zipper strip according to claim 1 wherein said female profile includes a high compression member longer than said female interlocking member.

7. The zipper strip according to claim 1 wherein the ends of said end high compression members are treated to prevent said end high compression members from being sealable to said other profile.

8. The zipper strip according to claim 1 wherein said high compression members are contactable with the base of the other profile.

9. The zipper strip according to claim 1 wherein each of said high compression members is contactable with an opposite high compression member on the other profile.

10. The zipper strip according to claim 1 wherein one of said male and female profiles includes a high compression member positioned between its interlocking members contactable with the base of the other profile.

11. The zipper strip according to claim 10 wherein said other profile includes a channel for receiving said high high compression member.

12. The zipper strip according to claim 11 wherein said channel is formed from two high compression members contactable with the base of said one profile.

13. The zipper strip according to claim 1 wherein said at least one high compression member is thicker than at least one of said interlocking members.

14. A reclosable package comprising:

a first wall and a second wall opposite said first wall;

a zipper strip for selectively opening and closing said package, said zipper strip comprising a male profile extending along an internal surface of said first wall and a female profile extending along an internal surface of said second wall;

said male profile including a base and two interlocking members extending from said base toward said female profile;

said female profile including a base and two interlocking members extending from said base toward said male profile, said two male interlocking member being engageable within said two female interlocking member to join said male and female profiles together;

at least one of said male and female profiles further including first and second high compression members positioned on opposite ends of its base and a third high compression member positioned between its interlocking members extending from its base toward the other profile, said high compression members being contactable with a portion of the other profile when said profiles are interlocked and pressed together so as to prevent the extremities of said interlocking members from contacting the opposite profile so that said profiles can be sealed to said opposing bag wall internal surfaces across the entire widths of their respective bases through the application of heat and pressure without damaging or distorting said male and female interlocking members;

wherein said profiles are sealed to said opposing bag wall internal surfaces across the widths of their respective bases.

* * * * *